US010711496B2

(12) United States Patent
He et al.

(10) Patent No.: US 10,711,496 B2
(45) Date of Patent: Jul. 14, 2020

(54) REFRIGERATOR

(71) Applicant: QINGDAO HAIER JOINT STOCK CO., LTD., Qingdao, Shandong Province (CN)

(72) Inventors: Guoshun He, Qingdao (CN); Enpin Xia, Qingdao (CN); Hao Zhang, Qingdao (CN); Xiaobing Zhu, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 16/461,767

(22) PCT Filed: Dec. 29, 2016

(86) PCT No.: PCT/CN2016/112816
§ 371 (c)(1),
(2) Date: May 16, 2019

(87) PCT Pub. No.: WO2018/090458
PCT Pub. Date: May 24, 2018

(65) Prior Publication Data

US 2019/0323272 A1 Oct. 24, 2019

(30) Foreign Application Priority Data

Nov. 16, 2016 (CN) ..... 2016 1 1030649

(51) Int. Cl.
*E05D 3/12* (2006.01)
*E05D 7/08* (2006.01)
(Continued)

(52) U.S. Cl.
CPC ..... *E05D 3/12* (2013.01); *E05D 7/081* (2013.01); *F25D 23/028* (2013.01); *F25D 2323/024* (2013.01)

(58) Field of Classification Search
CPC ... F25D 2323/024; Y10T 16/544; E05D 1/04; E05D 3/18; E05D 3/12; E05D 7/081
(Continued)

(56) References Cited

U.S. PATENT DOCUMENTS 2,920,341 A * 1/1960 Amstutz ..... E05D 7/081 16/260
3,065,498 A * 11/1962 Johnson ..... E05D 7/081 16/359
(Continued)

FOREIGN PATENT DOCUMENTS

CN 202055672 U 11/2011
CN 203905683 U 10/2014
(Continued)

*Primary Examiner* — Andrew M Roersma
(74) *Attorney, Agent, or Firm* — Cheng-Ju Chiang

(57) ABSTRACT

A refrigerator comprising a refrigerator body and a door body. The refrigerator body comprises a fixed hinge and a movable hinge. One extremity of the fixed hinge is fixed on the refrigerator body; the other extremity protrudes the refrigerator body and is provided with a guide shaft protruding towards the door body. A guide groove used for fitting the guide shaft is provided on the door body. The guide groove comprises a first groove. One extremity of the movable hinge is pivotally connected to the refrigerator body by employing a first rotating shaft and a first rotating groove; the other extremity protrudes the refrigerator body and is pivotally connected to the door body by employing a second rotating shaft and a second rotating groove.

10 Claims, 4 Drawing Sheets

(51) Int. Cl.
*F25D 23/02* (2006.01)
*E05D 7/081* (2006.01)

(58) Field of Classification Search
USPC ..... 49/276, 277, 278
See application file for complete search history.

(56) References Cited

U.S. PATENT DOCUMENTS 4,068,348 A * 1/1978 Chivers ..... E05D 3/12
16/235
5,265,954 A * 11/1993 Keil ..... E05D 11/00
16/358

FOREIGN PATENT DOCUMENTS

| | | | | |
|---|---|---|---|---|
| CN | 204850832 U | 12/2015 | | |
| CN | 204899511 U | 12/2015 | | |
| DE | 3530199 A1 * | 5/1986 | ..... | E05D 3/12 |
| EP | 1712856 A3 | 5/2013 | | |
| FR | 3043425 A1 * | 5/2017 | ..... | E05D 15/58 |
| KR | 10-0781601 B1 | 12/2007 | | |

* cited by examiner

REFRIGERATOR

The present application is a 35 U.S.C. § 371 National Phase conversion of International (PCT) Patent Application No. PCT/CN2016/112816, filed on Dec. 29, 2016, which claims the priority of Chinese Patent Application No. 201611030649.3, titled as "Refrigerator" and filed on Nov. 16, 2016, the content of which is incorporated herein by reference in its entirety. The PCT International Patent Application was filed and published in Chinese.

TECHNICAL FIELD

The present invention relates to a refrigerator.

BACKGROUND

In a conventional side-by-side refrigerator, a reversible vertical beam is disposed on a door body at one side to seal a gap between two door bodies, such that cold air is prevented from escaping. In order to ensure that the vertical beam can be normally overturned, enough space has to be reserved around it. However, in this case, not only is the storage space of the refrigerator reduced, but also taking and placing of food by a user will be adversely affected. In addition, after the refrigerator is transported or a user uses it for a long time, the door bodies and the vertical beam may sink, which results in a poor match between the vertical beam and a refrigerator body of the refrigerator. Further, such problems as escaping of cold air may be caused.

In view of this, it is necessary to improve the conventional refrigerator to solve the above-mentioned problems.

SUMMARY

An objective of the present invention is to provide a refrigerator to solve the problems of a conventional refrigerator that a vertical beam is prone to damages and cold air leaks easily.

To fulfill this objective, the present invention provides a refrigerator, including a refrigerator body and a door body configured to open and close the refrigerator body. The refrigerator body includes a fixed hinge and a movable hinge. One end of the fixed hinge is secured to the refrigerator body, and the other end of the fixed hinge protrudes outwards and stretches out of the refrigerator body and is provided with a guide shaft, facing the door body, in a protruding manner. A guide groove configured to match the guide shaft is formed in the door body and includes a first groove. The first groove has a first position and a second position and obliquely extends inwards from the first position to the second position in a width direction and a thickness direction of the refrigerator. One end of the movable hinge is pivotally connected to the refrigerator body by a first rotating shaft and a second rotating groove, and the other end of the movable hinge protrudes outwards and stretches out of the refrigerator body and is pivotally connected to the door body by a second rotating shaft and a second rotating groove.

The guide shaft is located in the first position of the first groove when the door body is in an initial closed state. The door body rotates by taking the second rotating shaft as the axis when opened. Meanwhile, the second rotating shaft rotates by taking the first rotating shaft as the axis. The door body moves outwards for a certain distance in the width direction of the refrigerator. The guide shaft slides in the guide groove from the first position to the second position.

As an improvement of the present invention, the guide groove further includes a second groove that is communicated with the first groove. The second groove extends in a circular-arc shape by taking the center axis of the first rotating shaft as a circle center. The second groove has a third position and a fourth position. The third position is close to the second position.

The door body rotates by taking the second rotating shaft as the axis when the guide shaft is located in the second position and the door body is opened further. The guide shaft slides in the guide groove from the second position to the third position and then to the fourth position.

As a further improvement of the present invention, the second rotating shaft is disposed outwards relative to the first groove in the width direction of the refrigerator.

As a further improvement of the present invention, a limiting portion, of which an opening faces the movable hinge and which is configured to limit the position of the second rotating shaft, is disposed on the fixed hinge. The second rotating shaft props against the limiting portion when the door body is in the initial closed state.

As a further improvement of the present invention, a stepped portion configured to accommodate the movable hinge is disposed on the fixed hinge.

As a further improvement of the present invention, the first rotating shaft is disposed on the movable hinge. The first rotating groove is formed in the fixed hinge.

As a further improvement of the present invention, the second rotating shaft is disposed on the movable hinge. The door body further includes a mounting groove and a mounting block disposed in the mounting groove. The guide groove and the second rotating groove are formed in the mounting block.

As a further improvement of the present invention, the mounting block is rectangular.

As a further improvement of the present invention, the door body includes a first door body and a second door body. Sealing pieces are disposed on opposite sides of the first door body and the second door body respectively.

As a further improvement of the present invention, magnets with opposite polarities are embedded into the sealing pieces of the first door body and the second door body respectively.

The refrigerator of the present invention has the beneficial effect that as the fixed hinge and the movable hinge are disposed, the door body moves outwards for a certain distance in the width direction of the refrigerator when opened. Thus, friction between the sealing pieces of the two door bodies is reduced. The refrigerator provided by the present invention has the advantages that an excellent sealing effect is achieved, the sealing pieces are not easy to wear, the door body is low in forming difficulty and the cost is low.

DETAILED DESCRIPTION

Figure 1:
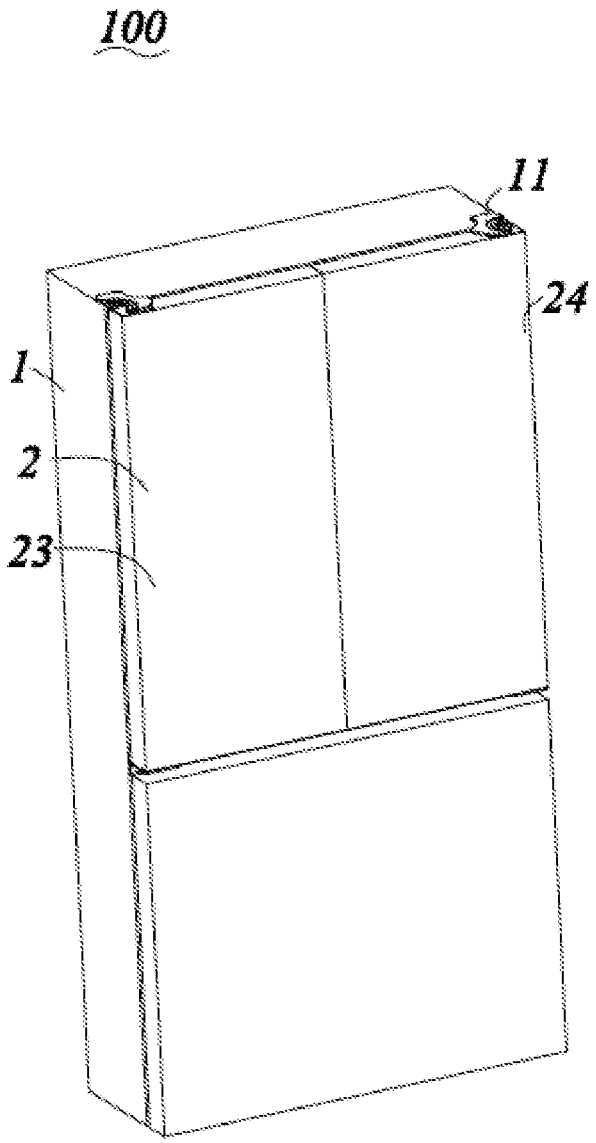
FIG. 1 is a schematic view of an overall structure of a refrigerator provided by the present invention.
Figure 2:
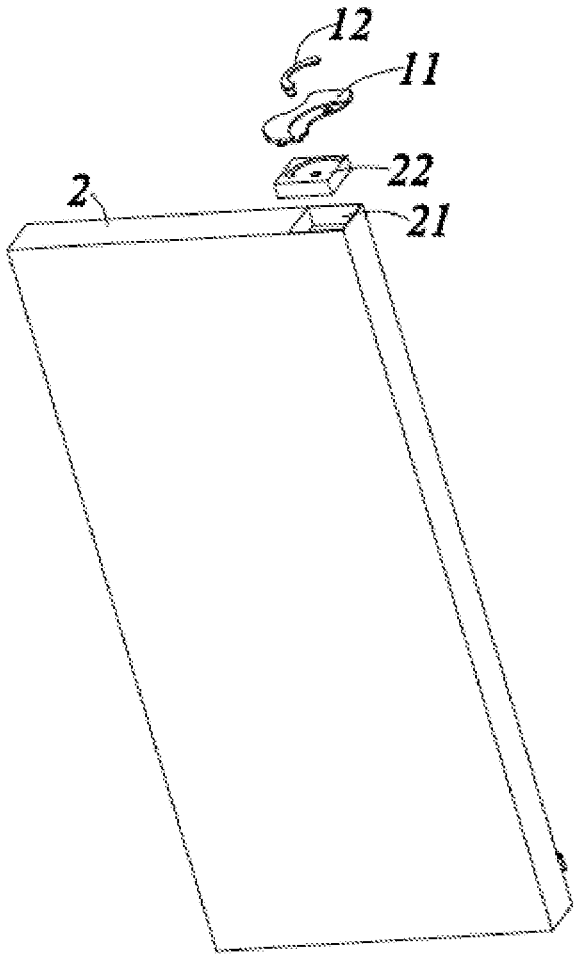
FIG. 2 is a schematic structural view of a door body, a fixed hinge and a movable hinge in FIG. 1.
Figure 3:
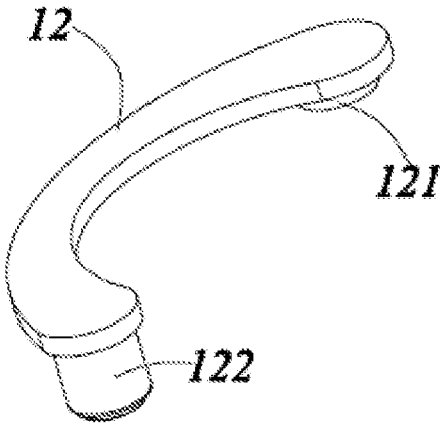
FIG. 3 is a schematic structural view of the movable hinge in FIG. 2.
Figure 4:
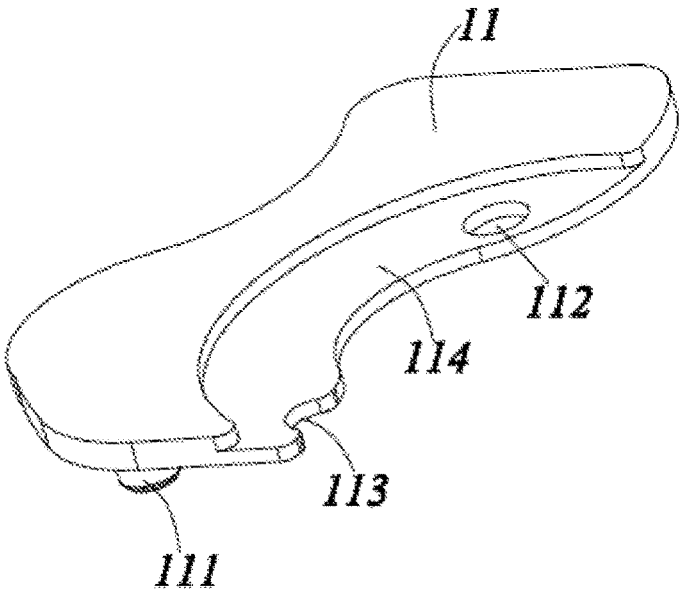
FIG. 4 is a schematic structural view of the fixed hinge in FIG. 2.

To make objectives, technical solutions and advantages of the present invention clearer, the present invention will be described in detail below with reference to the accompanying drawings and specific embodiments.

As shown in FIGS. 1-5, a refrigerator 100 provided by the present invention includes a refrigerator body 1 and a door body 2 configured to open and close the refrigerator body 1.

The refrigerator body 1 includes a fixed hinge 11 and a movable hinge 12.

A stepped portion 114 configured to accommodate the movable hinge 12 is disposed on the fixed hinge 11. The movable hinge 12 is slightly thinner than the fixed hinge 11, such that the top of the movable hinge 12 is aligned with that of the fixed hinge 11 when the movable hinge 12 is accommodated in the stepped portion 114.

One end of the fixed hinge 11 is secured to the refrigerator body 1, and the other end of the fixed hinge 11 protrudes outwards and stretches out of the refrigerator body 1 and is provided with a guide shaft 111, facing the door body 2, in a protruding manner. A guide groove 221 configured to match the guide shaft 111 is formed in the door body 2.

Figure 5:
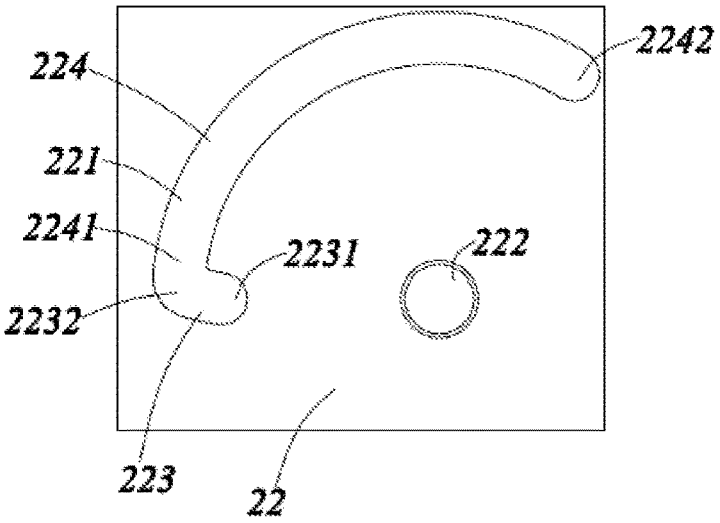
FIG. 5 is a schematic structural view of a mounting block in FIG. 2.

As shown in FIG. 5, the guide groove 221 includes a first groove 223 and a second groove 224.

The first groove 223 has a first position 2231 and a second position 2232 and obliquely extends inwards from the first position 2231 to the second position 2232 in a width direction and a thickness direction of the refrigerator 100.

The second groove 224 is communicated with the first groove 223 and extends in a circular-arc shape by taking the center axis of a first rotating shaft 121 as a circle center. The second groove 224 has a third position 2241 and a fourth position 2242. The third position 2241 is close to the second position 2232.

One end of the movable hinge 12 is pivotally connected to the refrigerator body 1 by the first rotating shaft 121 and a first rotating groove 112, and the other end of the movable hinge 12 protrudes outwards and stretches out of the refrigerator body 1 and is pivotally connected to the door body 2 by a second rotating shaft 122 and a second rotating groove 222. In the present embodiment, the first rotating shaft 121 and the second rotating shaft 122 are disposed on the movable hinge 12, respectively. The first rotating groove 112 is formed in the stepped portion 114 of the fixed hinge 11 of the refrigerator body 1. The second rotating groove 222 is formed in the door body 2 and disposed outwards relative to the first groove 223 in the width direction of the refrigerator 100.

A limiting portion 113, of which an opening faces the movable hinge 12 and which is configured to limit the position of the second rotating shaft 122, is disposed on the fixed hinge 11. The second rotating shaft 122 props against the limiting portion 113 when the door body 2 is in the initial closed state.

The door body 2 includes a first door body 23 and a second door body 24. Sealing pieces (not shown) are disposed on opposite sides of the first door body 23 and the second door body 24 respectively. Magnets (not shown) with opposite polarities are embedded into the sealing pieces of the first door body 23 and the second door body 24 respectively and attract each other when the door body 2 is closed, such that cold air is prevented from escaping.

If the guide groove 221 and the second rotating groove 222 are directly formed in the door body 2, the forming difficulty and the cost are high. In the present embodiment, the door body 2 further includes a mounting groove 21 and a mounting block 22 disposed in the mounting groove 21. The mounting block 22 and the mounting groove 21 are correspondingly rectangular. The guide groove 221 and the second rotating groove 222 are disposed in the mounting block 22. Through cooperation between the mounting groove 21 and the mounting block 22, the forming difficulty of the door body 2 and the cost of the refrigerator 100 are reduced.

Figure 6:
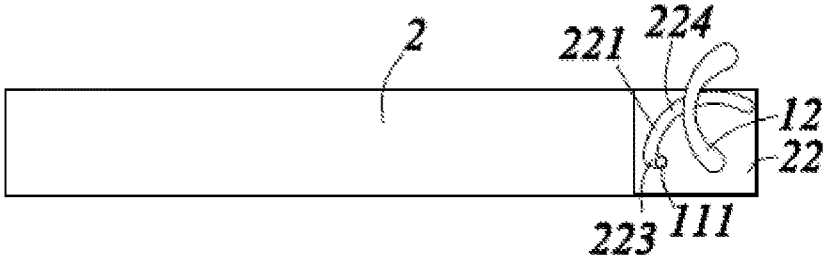
FIG. 6 is a top view of the door body in a closed state in FIG. 1.
Figure 7:
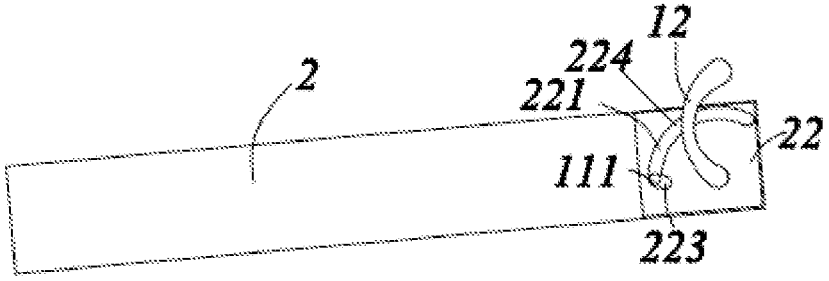
FIG. 7 is a top view of the door body in an opened state in FIG. 1.
Figure 8:
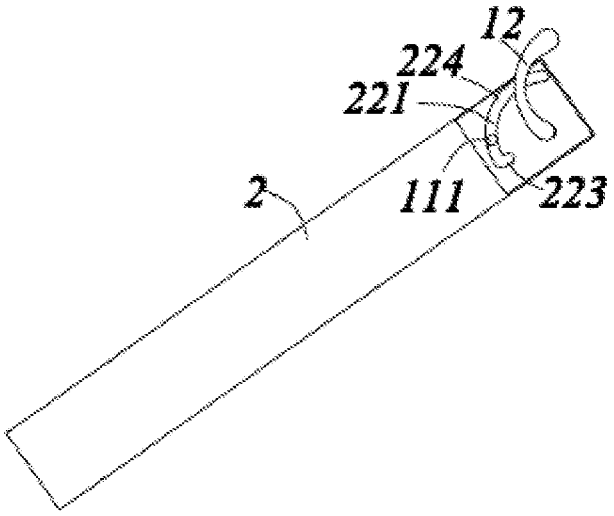
FIG. 8 is a top view of the door body in another opened state in FIG. 1.

As shown in FIGS. 6-8, the door body 2 of the refrigerator 100 provided by the present invention is opened in the following process.

When the door body 2 is in the initial closed state, the guide shaft 111 is located in the first position 2231 of the first groove 223. The second rotating shaft 122 props against the limiting portion 113.

The door body 2 rotates by taking the second rotating shaft 122 as the axis when opened. Meanwhile, the second rotating shaft 122 rotates by taking the first rotating shaft 121 as the axis, and the door body 2 moves outwards for a certain distance in the width direction of the refrigerator 100, such that the sealing pieces of the first door body 23 and the second door body 24 are prevented from mutual friction. The guide shaft 111 slides in the guide groove 221 from the first position 2231 to the second position 2232.

The door body 2 rotates by taking the second rotating shaft 122 as the axis when opened further. The guide shaft 111 slides in the guide groove 221 from the second position 2232 to the third position 2241 and then to the fourth position 2242. At this time, the door body 2 is in a fully-opened state.

The door body 2 of the refrigerator 100 provided by the present invention is closed in the following process.

The guide shaft 111 is in the fourth position 2242 of the second groove 224 when the door body 2 is in the fully-opened state.

The door body 2 rotates by taking the second rotating shaft 122 as the axis when closed. The guide shaft 111 slides in the guide groove 221 from the fourth position 2242 to the third position 2241.

The door body 2 rotates by taking the second rotating shaft 122 as the axis when closed further. Meanwhile, the second rotating shaft 122 rotates by taking the first rotating shaft 121 as the axis. The door body 2 moves inwards for a certain distance in the width direction of the refrigerator 100. The guide shaft 111 slides in the guide groove 221 from the third position 2241 to the second position 2232 and then to the first position 2231. At this time, the second rotating shaft 122 props against the limiting portion 113. The door body 2 is in a closed state.

According to the refrigerator 100 provided by the present invention, as the fixed hinge 11 and the movable hinge 12 are disposed, the door body 2 moves outwards for a certain distance in the width direction of the refrigerator 100 when opened. Thus, friction between the sealing pieces of the two door bodies 2 is reduced. As the second rotating groove 222 and the guide groove 221 are formed in the mounting block 22, and the mounting groove 21 that matches the mounting block 22 is formed in the door body 2, the forming difficulty of the door body 2 and the cost of the refrigerator 100 are reduced. The refrigerator 100 has the advantages that an excellent sealing effect is achieved, the sealing pieces are not easy to wear, the door body 2 is low in forming difficulty and the cost is low.

The above embodiments are only used to illustrate the technical solution of the present invention rather than limit the same. Although the present invention is described in detail with reference to the preferred embodiments, those skilled in the art should understand that the technical solution of the present invention may be modified or substituted without departing from the spirit and scope of the technical solution of the present invention.

What is claimed is:

1. A refrigerator, comprising a refrigerator body and a door body configured to open and close the refrigerator body, wherein the refrigerator body comprises a fixed hinge and a movable hinge; a first end of the fixed hinge is secured to the refrigerator body, and a second end of the fixed hinge protrudes outwards and stretches out of the refrigerator body and is provided with a guide shaft, facing the door body, in a protruding manner; a guide groove configured to match the guide shaft is formed in the door body and comprises a first groove; the first groove has a first position and a second position and obliquely extends inwards from the first position to the second position in a width direction and a thickness direction of the refrigerator; a first end of the movable hinge is pivotally connected to the refrigerator body by a first rotating shaft and a first rotating groove, and a second end of the movable hinge protrudes outwards and stretches out of the refrigerator body and is pivotally connected to the door body by a second rotating shaft and a second rotating groove; and the guide shaft is located in the first position of the first groove when the door body is in an initial closed state; the door body rotates by taking the second rotating shaft as a rotation axis of the door body when opened; and meanwhile, the second rotating shaft rotates by taking the first rotating shaft as a rotation axis of the second rotating shaft, the door body moves outwards by a certain distance in the width direction of the refrigerator, and the guide shaft slides in the guide groove from the first position to the second position.

2. The refrigerator according to claim 1, wherein the guide groove further comprises a second groove that is communicated with the first groove; the second groove extends in a circular-arc shape by taking a center axis of the first rotating shaft as a circle center; the second groove has a third position and a fourth position, and the third position is close to the second position; and the door body rotates by taking the second rotating shaft as the rotation axis of the door body when the guide shaft is located in the second position and the door body is opened further, and the guide shaft slides in the guide groove from the second position to the third position and then to the fourth position.

3. The refrigerator according to claim 1, wherein the second rotating shaft is disposed outwards relative to the first groove in the width direction of the refrigerator.

4. The refrigerator according to claim 3, wherein a limiting portion, of which an opening faces the movable hinge and which is configured to limit a position of the second rotating shaft, is disposed on the fixed hinge, and the second rotating shaft props against the limiting portion when the door body is in the initial closed state.

5. The refrigerator according to claim 1, wherein a stepped portion configured to accommodate the movable hinge is disposed on the fixed hinge.

6. The refrigerator according to claim 1, wherein the first rotating shaft is disposed on the movable hinge, and the first rotating groove is formed in the fixed hinge.

7. The refrigerator according to claim 1, wherein the second rotating shaft is disposed on the movable hinge; the door body comprises a mounting groove and a mounting block disposed in the mounting groove, and the guide groove and the second rotating groove are formed in the mounting block.

8. The refrigerator according to claim 7, wherein the mounting block is rectangular.

9. The refrigerator according to claim 1, wherein the door body comprises a first door body and a second door body, and sealing pieces are disposed on opposite sides of the first door body and the second door body respectively.

10. The refrigerator according to claim 9, wherein magnets with opposite polarities are embedded into the sealing pieces of the first door body and the second door body respectively.

* * * * *